US006059696A

United States Patent [19]

Bohmer et al.

[11] Patent Number: 6,059,696

[45] Date of Patent: May 9, 2000

[54] DEVICE FOR RENDERING NATURAL WALKING MOTION ON A TREADMILL

[76] Inventors: William Bohmer, 1 Schindler Dr., Succasunna, N.J. 07876; George Gordon, 1178 Debra Dr., Linden, N.J. 07036

[21] Appl. No.: 09/266,303

[22] Filed: Mar. 11, 1999

Related U.S. Application Data

[62] Division of application No. 08/740,841, Nov. 4, 1996, Pat. No. 5,919,119.

[51] Int. Cl.[7] ..... A63B 21/02

[52] U.S. Cl. ..... 482/54; 482/69

[58] Field of Search ..... 482/54, 69, 74, 482/129

[56] References Cited

U.S. PATENT DOCUMENTS 5,176,597 1/1993 Byrne ..... 482/74

5,512,029 4/1996 Barnard et al. ..... 482/129

5,704,880 1/1998 Amutelle ..... 482/54

*Primary Examiner*—Glenn E. Richman

*Attorney, Agent, or Firm*—John Q. McQuillan

[57] ABSTRACT

There is disclosed a belt for supporting an individual walking on a treadmill. The belt has an elastic section adjacent each of the opposite ends thereof. The belt is positioned behind the back of an individual walking on the treadmill and the opposite ends of the belt are attached to the treadmill. The belt when attached to the treadmill enables an individual walking on the treadmill to walk "hands-free", thereby enabling the individual to walk comfortably with arms swinging in a natural manner. There is also disclosed a motor device for changing the resistance applied by the belt to the user.

5 Claims, 4 Drawing Sheets

DEVICE FOR RENDERING NATURAL WALKING MOTION ON A TREADMILL

This is a Division of application Ser. No. 08/740,841, filed on Nov. 4, 1996, U.S. Pat. No. 5,919,119.

BACKGROUND OF THE INVENTION

The use of motorized treadmills has become widespread as a means of convenient physical exercise. The treadmills utilize motorized or manual endless loop flat belts upon which the user walks. The belt moves counter to the direction of the walking motion, thereby simulating travel over a physical distance. The treadmill speed is usually variable in order to render different walking speeds. The treadmills also utilize variable inclined positions in order to simulate changes in the grade of the terrain. The treadmills incorporate either front or side railings or bars which provide support for the user to grip while walking. It is usually necessary to grip the railings or bars because it becomes difficult to keep ones balance when a moving force is exerted on the lower portion (feet) of the body. This difficulty creates a certain artificial feel due to the inactivity of the upper body (arms and shoulders). It is possible to walk on the treadmill with arms to one side but this requires delicate balance which may create mental stress. Any mental stress negates the benefits of a relaxed prolonged physical regimen. The inability of the existing treadmills to simulate realistic conditions is a significant problem which may deter many persons from desiring and purchasing treadmills.

SUMMARY OF THE INVENTION

It is an object of the invention to provide a device for use with a treadmill which eliminates the need of the user to grip a support bar of the treadmill without losing their balance.

Another object of the invention is to create a hands-free motion which closely simulates true walking.

Still another object of the invention is to provide the device as an accessory which may be added to any existing treadmill.

A further object of the invention is to incorporate the device into the design of future treadmills.

An additional object of the invention is to make the device manually adjustable for a variety of conditions.

Still another object of the invention is to make the device automatically adjustable by means of the electronic control of a feedback system.

It is also an additional object of the invention is to enhance the safety and comfort of the treadmill in order to facilitate higher treadmill speeds.

DESCRIPTION OF THE PREFERRED EMBODIMENTS

Figure 1:
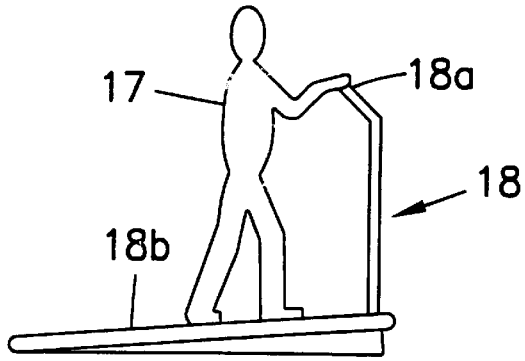
FIG. 1 is an elevation view showing an individual using a standard treadmill.

FIG. 1 shows a treadmill 18 in operation in the regular mode with an individual or user 17 holding on to the support bar 18*a* of the treadmill.

Figure 2:
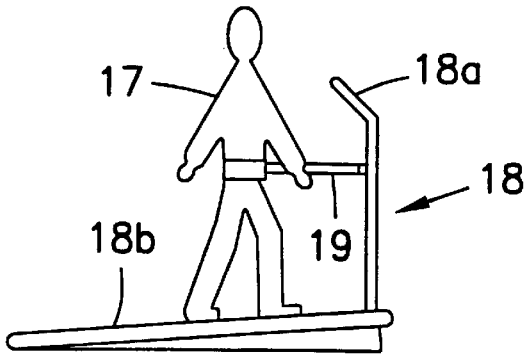
FIG. 2 is an elevation view of the invention in use with an individual on a treadmill.

FIG. 2 shows treadmill 18 in operation with the device 19 of the invention (shown as 20 in FIG. 3, 30 in FIG. 6, and 40 in FIG. 11) and depicts the individual user 17 walking freely on the belt 18*b* of the treadmill with the device 19 of invention connected to upright 18*a* of the treadmill 18.

Figure 3:
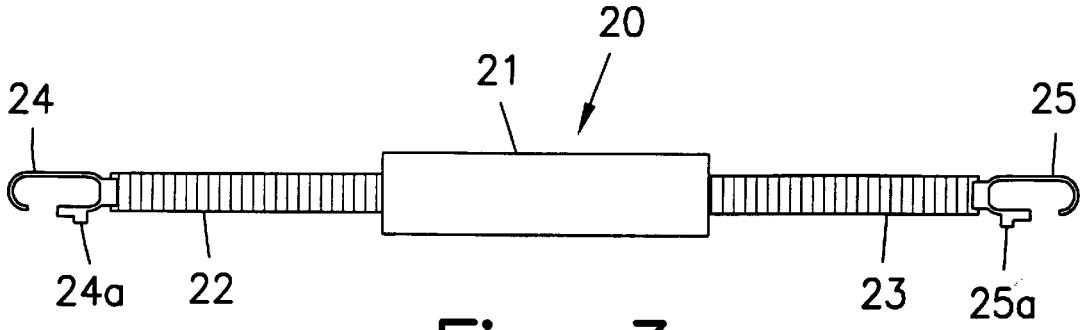
FIG. 3 is a plan view of the narrow belt of the invention with hooks attached to each end of the belt with elastic straps of fixed length.

The first embodiment 20 of the device of the invention is shown in FIG. 3. A flat cushioned support member 21 is shown with straps 22 and 23 and hooks 24 and 25 connected at each end. The straps 22 and 23 are elastic and of a fixed length. At the end of the straps 22 and 23 there are hooks 24 and 25 which have spring-loaded latches 24*a* and 25*a*, respectively, which enable the hooks 24 and 25 to be attached easily to any bar or other support structure 18*a* (FIG. 2) on the treadmill 18. The user 17 places the support member 21 behind his or her back and connects the hooks 24 and 25 to the right and left side of the treadmill.

Figure 4:
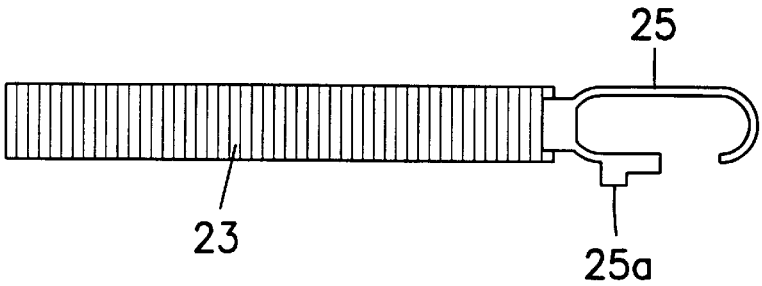
FIG. 4 is a fragmentary plan view of the invention showing the hook at one end of the belt in an open position.
Figure 5:
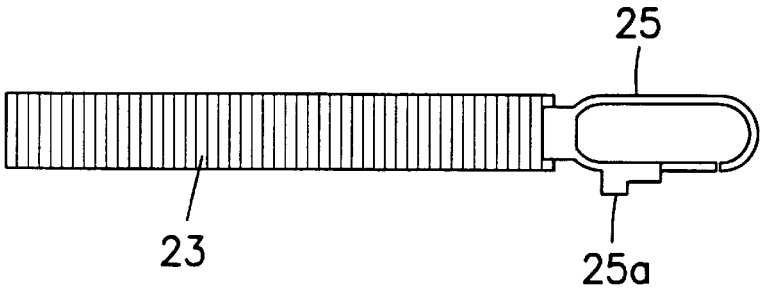
FIG. 5 is a fragmentary plan view of the invention showing the hook at one end of the belt in a closed or locked position.

FIG. 4 shows hook 25 with latch 25*a* in an open position while FIG. 5 shows hook 25 with latch 25*a* in a closed or locked position when attached to the treadmill.

The treadmill is activated and the user begins walking against the oncoming motion of the treadmill belt. The invention of device 20 supports the user and prevents loss of balance, thereby enabling the user to release their hands from the treadmill support bar and swing their arms to the side, rendering a natural walking motion.

It is the elastic straps 22 and 23 (FIG. 3) which enhance the operation of the device 20 of the invention. The elasticity of the straps absorbs the conflicting forces of the treadmill belt movement and walking motion, thereby rendering ease of balance. The degree of elasticity is determined by the length of the straps 22 and 23 and the characteristics of the flexible material forming the straps. FIG. 3 shows the device 20 with fixed length straps 22 and 23 made of a material with a fixed elasticity. The embodiment 20 in FIG. 3 can be manufactured in different sizes, incorporating a variety of cushioned support members, strap lengths, and elasticity to suit users of varying build and weight.

Figure 6:
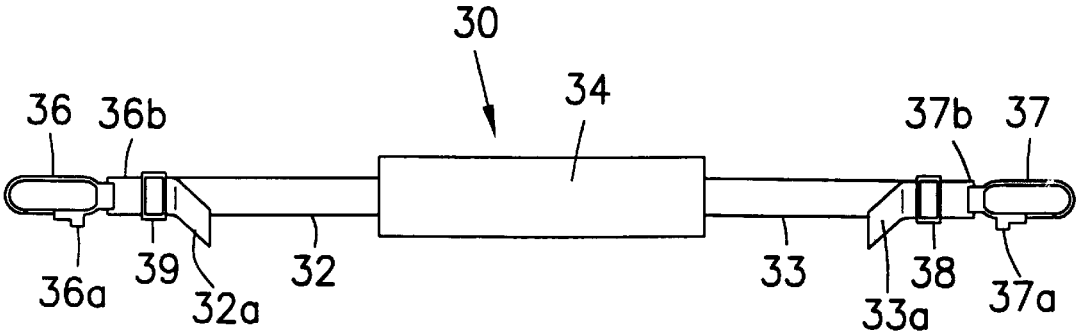
FIG. 6 is a plan view of the invention showing a narrow belt with hooks attached to each end of the belt with adjustable length elastic straps.

Another embodiment of the belt 30 of the invention is shown in FIG. 6. A flat cushioned support member 34 is shown with elastic straps 32 and 33 connected at one end of each strap to the support member 34 and to support hooks 36 and 37, respectively, at the other end of each strap. The total length of the elastic straps 32 and 33 can be changed by varying the length of the looped straps which are fed through the slots 36*b* and 37*b* on the support hooks 36 and 37, respectively, and routed back and held in position by the slip-pinch buckles 38 and 39, respectively. The support hooks 36 and 37 have spring-loaded latches, 36*a* and 37*a*, respectively, which enables the openings of hooks 36 and 37 to be easily attached to any bar or other support structure 18*a* on the treadmill.

The user places the support member 30 behind his or her back and connects the support hooks 36 and 37 to the right and left side of the treadmill 18. The treadmill 18 is activated and the user 17 begins walking against the oncoming motion of the tread belt 18*b*. The device 30 of the invention supports the user 17 and prevents loss of balance, thereby enabling the user 17 to release his or her hands from the treadmill support bar 18*a* and to swing their arms to the side, rendering natural walking motion. The elasticity of the straps 32 and 33 absorbs the conflicting forces of the treadmill belt movement and walking motion, rendering ease of balance.

In the embodiment 30 shown in FIG. 6, the degree of elasticity is determined by the length of the straps 32 and 33 attached to support member 34 which is determined by the position of the slip pinch buckles 38 and 39. The embodiment 30 in FIG. 6 may be made in one universal size. The degree of elasticity and therefore the natural hands-free walking motion on the treadmill 18 can be controlled by the user 17 by means of trial and error adjustments of the slip pinch buckles 38 and 39. Thus, the user 17 can customize the device 30 of the invention to account for any speed and incline angle of the treadmill.

Figure 7:
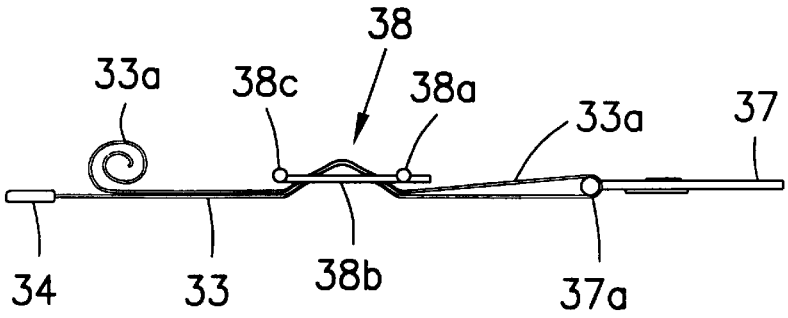
FIG. 7 is a fragmentary elevation view of the invention showing a buckle for adjusting the length of the narrow belt.
Figure 8:
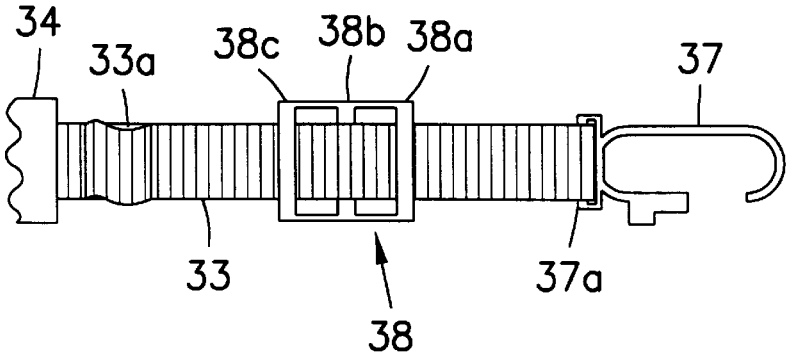
FIG. 8 is a fragmentary plan view of the invention showing a buckle for adjusting the length of the belt.
Figure 9:
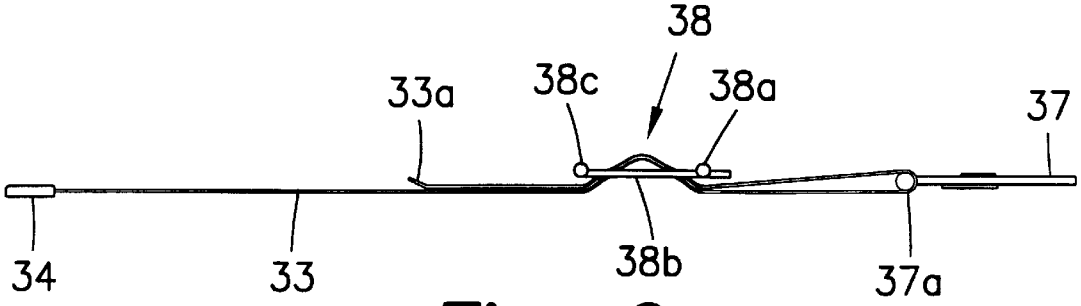
FIG. 9 is a fragmentary elevation view of the invention showing a buckle for adjusting the length of the narrow belt.
Figure 10:
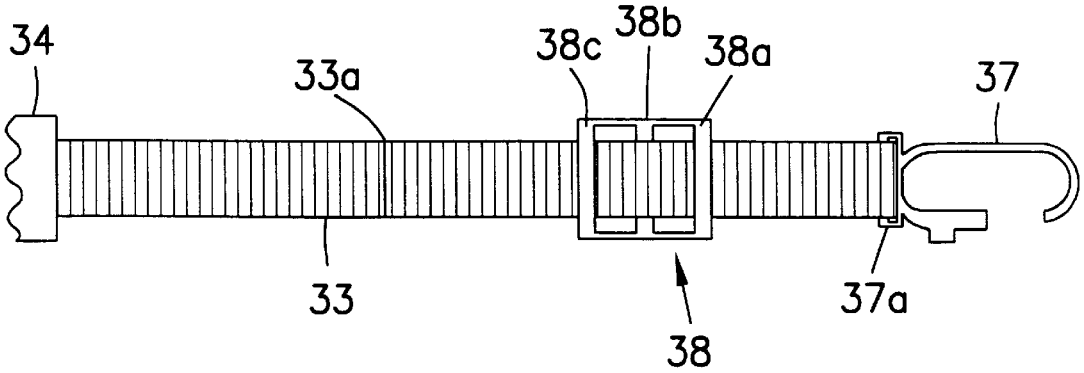
FIG. 10 is a fragmentary plan view of the invention showing a buckle for adjusting the length of the belt.

FIGS. 7,8,9, and 10 show the details of strap 33, slip pinch buckle 38, and support hook 37 of the embodiment 30 of FIG. 6. Thus as shown in FIGS. 7 and 8, strap 33 has folded end portion 33*a* passed through slot 37*a* of support hook 37 and extended beneath slide 38*a*, over slide 38*b*, and beneath slide 38*c* of buckle 38.

Figure 11:
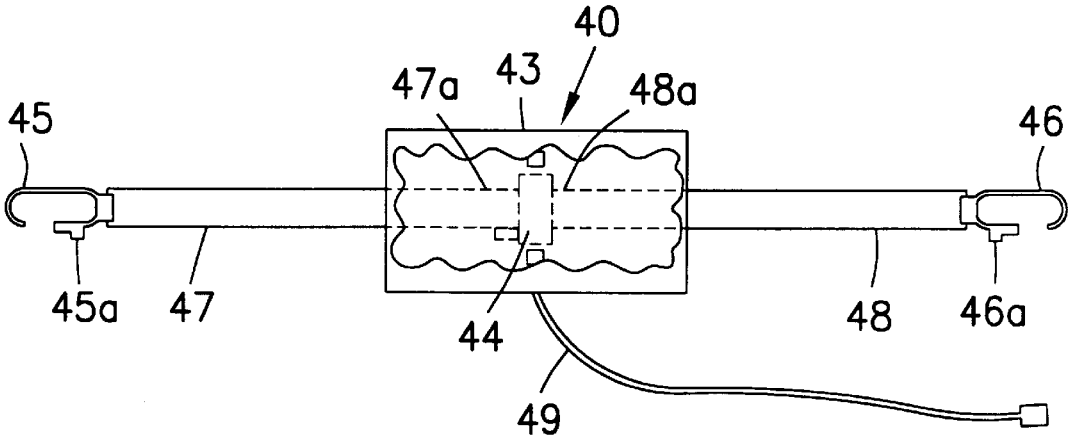
FIG. 11 is a fragmentary plan view of the invention showing a motor device for changing the resistance applied by the belt to the user.

Another embodiment of the device 40 of the invention is shown in FIG. 11. A flat cushioned support member 43 is shown with straps 47 and 48 connected to the support member 43 at one end and support hooks 45 and 46 at the other end. The straps 47 and 48 are of a constant length and have no elasticity. The straps 47 and 48 are connected indirectly to the flat cushioned support member 43 by means of an electronic resistance mechanism 44. The artificial resistance mechanism 44 is controlled by feedback data, such as treadmill belt speed and treadmill incline angle, received through the signal cable 49.

As shown in FIG. 11, the support hooks 45 and 46 have spring-loaded latches 45*a* and 46*a*, respectively, which enable the hooks 45 and 46 to be easily attached to any bar or other support structure 18*a* on the treadmill 18 (FIGS. 1 and 2). The user places the support member 43 behind his or her back and connects the support hooks 45 and 46 to the right and left side of the treadmill. The treadmill is activated and the user begins walking against the oncoming motion of tread belt 18*b*. The device 40 (FIG. 11) of the invention supports the user and prevents loss of balance, enabling the user to release their hands from the treadmill support bar 18*a* (FIGS. 1 and 2) and to swing his or her arms to the side, rendering a natural walking motion. The artificial elasticity of the straps 47 and 48 (FIG. 11) absorbs the conflicting forces of the treadmill belt movement and the walking motion, thereby providing ease of balance. The degree of artificial elasticity is determined by the feedback data coming from the treadmill by cable 49 and directed to the electronic resistance mechanism 44.

Figure 12:
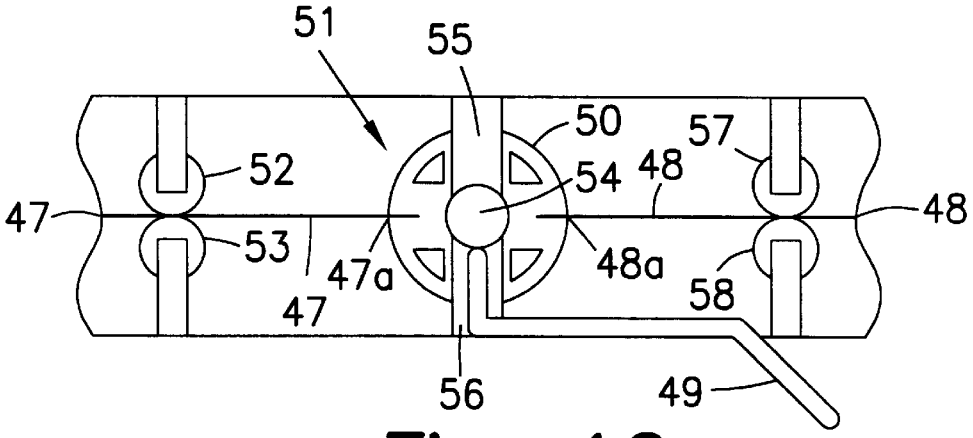
FIG. 12 is a fragmentary elevation view of the invention showing a motor device for changing the resistance applied by the belt to the user in a rest position.
Figure 13:
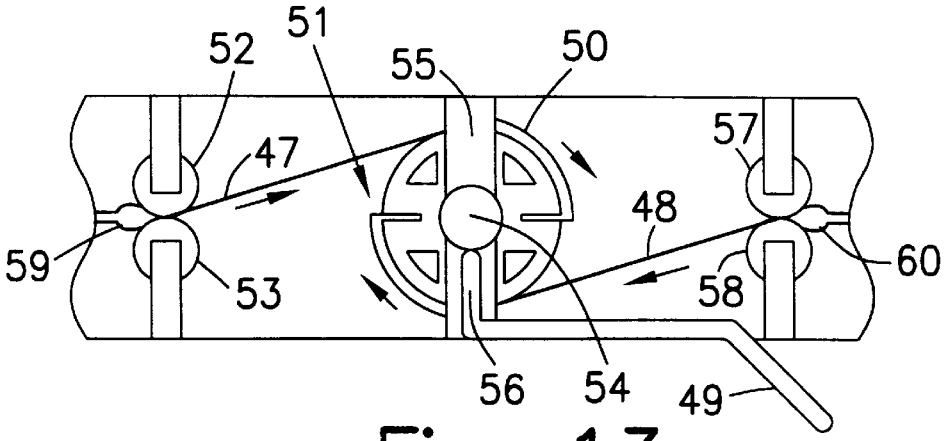
FIG. 13 is a fragmentary elevation view of the invention showing a motor device for changing the resistance applied by the belt to the user in an activated position.

As shown in FIGS. 12 and 13, the ends 47*a* and 48*a* of the straps 47 and 48, respectively, which are inside the flat cushioned support member 43 are connected to drum 50 which is positioned by torquemotor 51. The position of drum 50 is changed by a torquemotor 51 which is coupled to the drum 50 and controlled by feedback data in the signal cable 49.

The ends 47*a* and 48*a* of the straps 47 and 48 are connected to drum 50 coupled to torquemotor 51. The torquemotor 51 rotates the drum 50 as shown in FIG. 12 and creates a force which pulls the straps 47 and 48 into the flat cushioned support member 43, thereby creating an artificial spring effect. The amount of torque of torquemotor 51 is controlled by an electrical signal from the treadmill, such as the treadmill device motor, on signal cable 49. Thus ends 47*a* and 48*a* of the straps are wound around a drum 50 which is connected to the shaft 54 of torquemotor 51. The torquemotor 51 and drum 50 combination can pull the straps 47 and 48 inside the flat cushioned support member 43, thereby creating an artificial spring. The amount of torquemotor 51 is controlled by feedback data in the signal cable 49.

In FIG. 11 the left strap 47 enters the electronic resistance mechanism 44 through guide rollers 52 and 53 (FIGS. 12 and 13) and is attached to the drum 50 of torquemotor 51 which is free to rotate on rotor extension 54 mounted on support members 55 and 56.

In FIG. 11 the right strap 48 enters the electronic resistance mechanisms 44 through guide roller 57 and 58 (FIGS. 12 and 13) and is attached to the drum 50 of torquemotor 51 which is free to rotate on rotor extension 54 mounted on support members 55 and 56. In the minimum resistance mode there is little or no voltage applied through signal line 49 to the torquemotor 51, thereby allowing straps 47 and 48 to extend completely outside of the mechanism 44 (FIG. 12). The minimum resistance mode occurs when the lower voltage applied through the signal line 44 is a proportional representation of a lower voltage applied to the treadmill motor at low speeds.

FIG. 13 shows the components of the electronic resistance mechanism 44 (FIG. 11) in the maximum resistance mode. The close-up view of straps 47 and 48 in FIG. 13 are the same straps shown as straps 47 and 48 connected to hooks 45 and 46, respectively, in FIG. 12. In FIG. 13, the left strap 47 enters the electronic resistance mechanism 44 (FIG. 11) through guide rollers 52 and 53 and is attached to the drum 50 of torquemotor 51 which is free to rotate on rotor extension 54 mounted on support members 55 and 56. In FIG. 13, the right strap 48 enters the electronic resistance mechanism 44 (FIG. 11) through guide rollers 57 and 58 and is attached to the drum 50 of torquemotor 51 which is free to rotate on rotor extensions 54 mounted on support members 55 and 56.

In the maximum resistance mode as shown in FIG. 13, there is high voltage applied through signal line 49 to the torquemotor 51, thereby forcing straps 47 and 48 to be pulled around the motor drum 50 until the strap movement is halted due to the restrictive pins 59 and 60, thereby preventing further movement of the straps 47 and 48 past the guide rollers 52 and 53 as well as 57 and 58, respectively. The maximum resistance mode exists when the high voltage applied through the signal line 49 is a proportional representation of the high voltage applied to the treadmill motor at high speeds. The artificial "spring" effect is rendered by the motion of the straps pulling against the strong or weak force of the motor.

The embodiment in FIGS. 11–13 may be provided by the treadmill manufacturer. The degree of elasticity and therefore the natural hands free-walking motion on the treadmill is automatically controlled by the treadmill based on a profile which is an input provided by the user.

Figure 14:
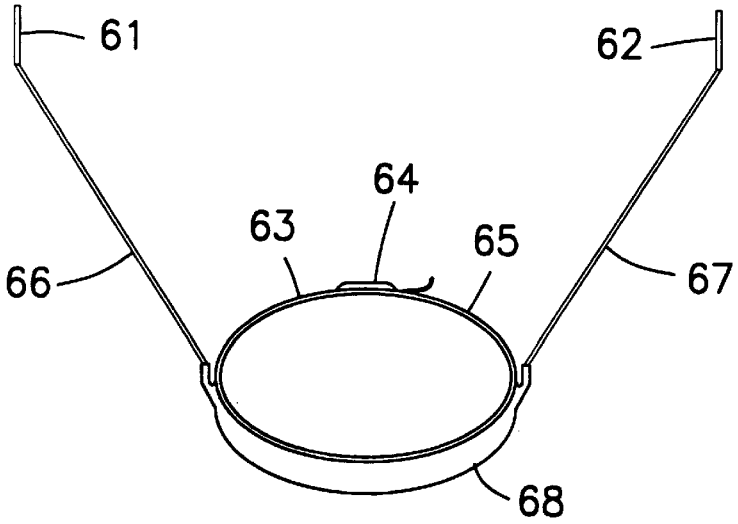
FIG. 14 is an isometric view of the belt of the invention having an additional portion for encircling the body of the user.

As shown in FIG. 14 in accordance with another embodiment of the invention, belt 68 which is adapted to engage the back of the user when the user is walking on a treadmill, is provided with hooks 61 and 62 for attachment to the upper portion of a treadmill. Belt 68 is provided with straps 63 and 65 attached to the opposite ends of belt 68. The straps secure belt 68 to the waist of the user when the straps are coupled by buckle 64. Accordingly, the straps 63 and 64, when buckled, secure the belt 68 and straps 63 and 64 about the body of the user and prevent any accidental falling or disengagement of the belt 68 when supporting a user on a treadmill.

What is claimed is:

1. Apparatus for engaging and supporting the back of an individual walking on a treadmill driven by an electric motor and having an upright portion for engagement by the hands of the user, the apparatus comprising an elongated support member adapted to extend laterally with respect to the back of the user when walking on the treadmill, a pair of belts each movably disposed at a different one of the opposite end of the elongated support member, each of the pair of belts having one end portion adapted to be attached to the upright portion of the treadmill, the pair of belts when attached to the upright portion of the treadmill enabling the support member to engage and support the back of the user walking on the treadmill and to free the hands and thereby the arms of the user with respect to the upright portion of the treadmill, and means disposed adjacent the elongated support member and in engagement with each of the other end portions of the pair of belts for tensioning the belts in electrical response to the drive of the treadmill by the electric motor with respect to the elongated support member and thereby with respect to the back of the user when walking on the treadmill.

2. Apparatus in accordance with claim 1 in which the means for tensioning the belts with respect to the elongated support member comprises an additional electric motor connected to the electric motor for driving the treadmill, the additional electric motor being adapted to tension the belts in response to the drive of the treadmill by the electric motor.

3. Apparatus in accordance with claim 1 in which the additional electric motor includes a pulley attached to and driven by the electric motor and in which the pulley is attached to the other end portion of each of the belts to tension the belts.

4. Apparatus in accordance with claim 2 in which the additional electric motor is a torquemotor.

5. A method for engaging and supporting the back of an individual walking on a treadmill driven by an electric motor and having an upright portion for engagement by the hands of the user, the method comprising the steps of providing an elongated support member adapted to extend tolerably with respect to the back of the user when walking on the treadmill, providing a pair of belts movably disposed at each of the opposite ends of the elongated support member, each of the pair of belts having one end portion adapted to be attached to the upright portion of the treadmill, enabling the pair of belts when attached to the upright portion of the treadmill to engage the support member to the back of the user walking on the treadmill and to free the hands and thereby the arms of the user with respect to the upright portion of the treadmill, tensioning of the pair of belts in electrical response to the drive of the treadmill by the electric motor with respect to the elongated support member and thereby with respect to the back of the user when walking on the treadmill.

* * * * *